US007793759B1

(12) United States Patent
Aiken, Jr.

(10) Patent No.: US 7,793,759 B1
(45) Date of Patent: Sep. 14, 2010

(54) LADDER LOCKING DEVICE AND METHOD

(76) Inventor: James R. Aiken, Jr., 26 Kirkland Dr., Mercer, PA (US) 16137

( * ) Notice: Subject to any disclaimer, the term of this patent is extended or adjusted under 35 U.S.C. 154(b) by 1006 days.

(21) Appl. No.: 11/501,370

(22) Filed: Aug. 9, 2006

(51) Int. Cl.
*E06C 5/00* (2006.01)

(52) U.S. Cl. ..... 182/106

(58) Field of Classification Search ..... 182/106; 160/84.09
See application file for complete search history.

(56) References Cited

U.S. PATENT DOCUMENTS 1,276,100 A * 8/1918 Niznik ..... 256/1
2,937,699 A * 5/1960 Ducharme ..... 160/84.09
4,126,206 A * 11/1978 Becnel ..... 182/129
4,557,082 A * 12/1985 Dunsworth ..... 52/109
5,421,428 A * 6/1995 Ingles ..... 182/106
5,441,126 A * 8/1995 Orrick ..... 182/106
6,789,838 B1 * 9/2004 Rubin ..... 296/152

* cited by examiner

*Primary Examiner*—Alvin C Chin-Shue

(57) ABSTRACT

A ladder locking device is disclosed. An illustrative embodiment of the ladder locking device includes a frame having a plurality of intersecting frame segments pivotally connected to each other in a scissors jack configuration and a foldable blind carried by the frame. A method of preventing unauthorized use of a ladder is also disclosed.

2 Claims, 4 Drawing Sheets

LADDER LOCKING DEVICE AND METHOD

FIELD

The present invention relates to ladders. More particularly, the present invention relates to a ladder locking device which can be attached to a ladder to prevent unauthorized use of the ladder.

BACKGROUND

Under various circumstances, it is desired to prevent unauthorized use of a ladder. For example, in hunting applications, an elevated deer stand is typically accessed by a ladder. When the deer stand is not in use, it may be desired for the owner of the deer stand to prevent unauthorized persons from accessing and using the deer stand and/or prevent theft of items from the deer stand.

SUMMARY

The present invention is generally directed to a ladder locking device. An illustrative embodiment of the ladder locking device includes a frame having a plurality of intersecting frame segments pivotally connected to each other in a scissors jack configuration and a foldable blind carried by the frame.

The present invention is further directed to a method of preventing unauthorized use of a ladder. An illustrative embodiment of the method includes providing a ladder locking device comprising a frame having a plurality of intersecting frame segments pivotally connected to each other in a scissors jack configuration and a foldable blind carried by the frame and attaching the frame to the ladder.

BRIEF DESCRIPTION OF THE DRAWINGS

The invention will now be described, by way of example, with reference to the accompanying drawings, in which.

DETAILED DESCRIPTION

Figure 2:
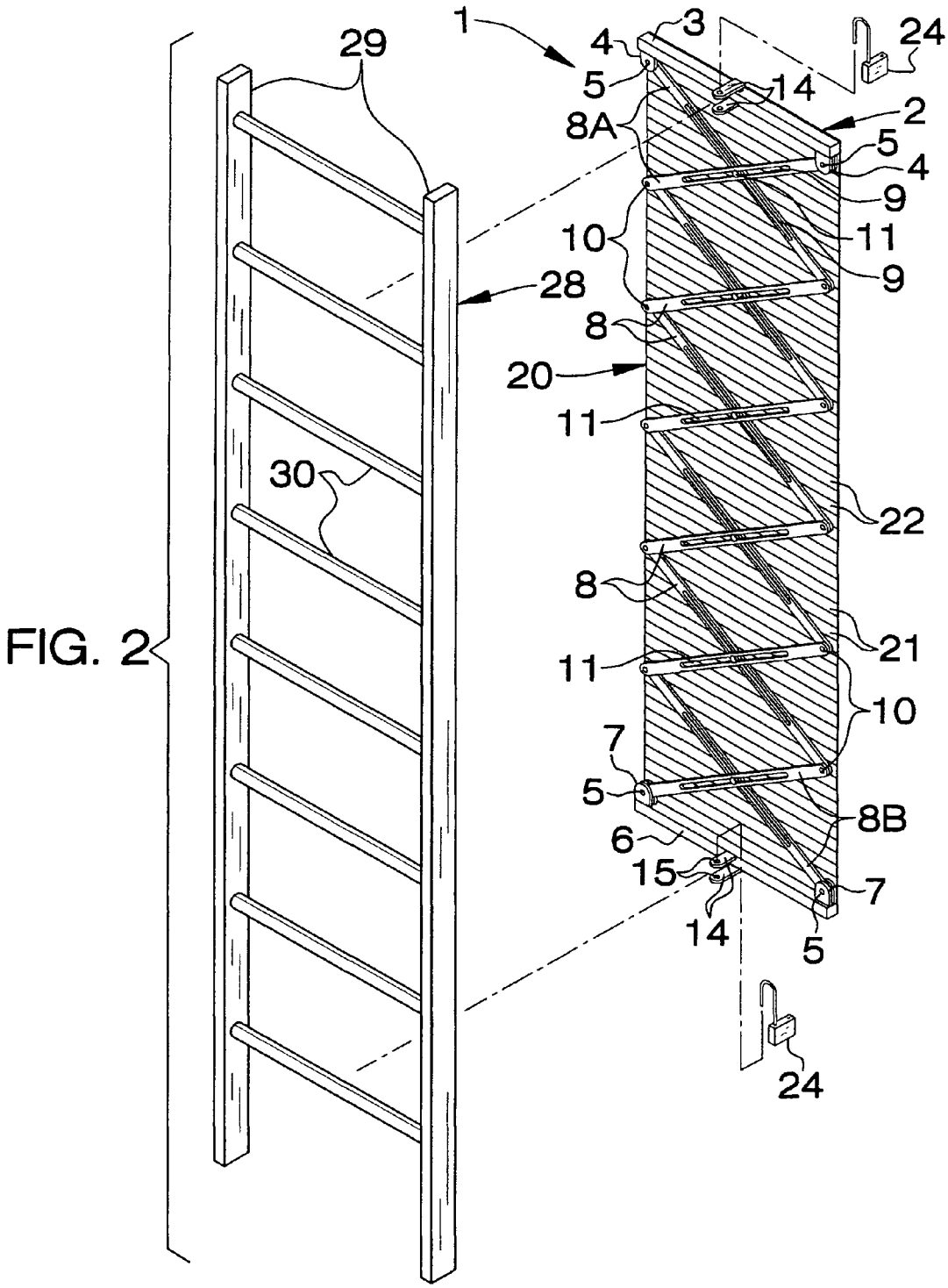
FIG. 2 is an exploded, perspective view of an illustrative embodiment of the ladder locking device, illustrating a typical manner of attaching the ladder locking device to a ladder.

Referring to the drawings, an illustrative embodiment of a ladder locking device is generally indicated by reference numeral 1. As shown in FIG. 2, the ladder locking device 1 includes a frame 2 having a generally elongated terminal frame member 3 and a generally elongated terminal frame member 6. A pair of generally elongated terminal frame segments 8*a* is pivotally attached to the terminal frame member 3. For example, two pairs of frame flanges 4 may extend from the terminal frame member 3, in spaced-apart relationship to each other. A pivot pin 5 may extend through a pin opening (not shown) provided in each corresponding pair of frame flanges 4 and through a registering pin opening (not shown) provided in the terminal frame member 3. In similar fashion, a pair of generally elongated terminal frame segments 8*b* is pivotally attached to the terminal frame member 6. Two pairs of frame flanges 7 may extend from the terminal frame member 6, in spaced-apart relationship to each other. The terminal frame segments 8*b* are pivotally attached to the respective frame flanges 7 by pivot pins 5. A pair of spaced-apart lock flanges 14, each having a lock flange opening 15, extends from the terminal frame member 3 and the terminal frame member 6, respectively, for purposes which will be hereinafter described.

Figure 4:
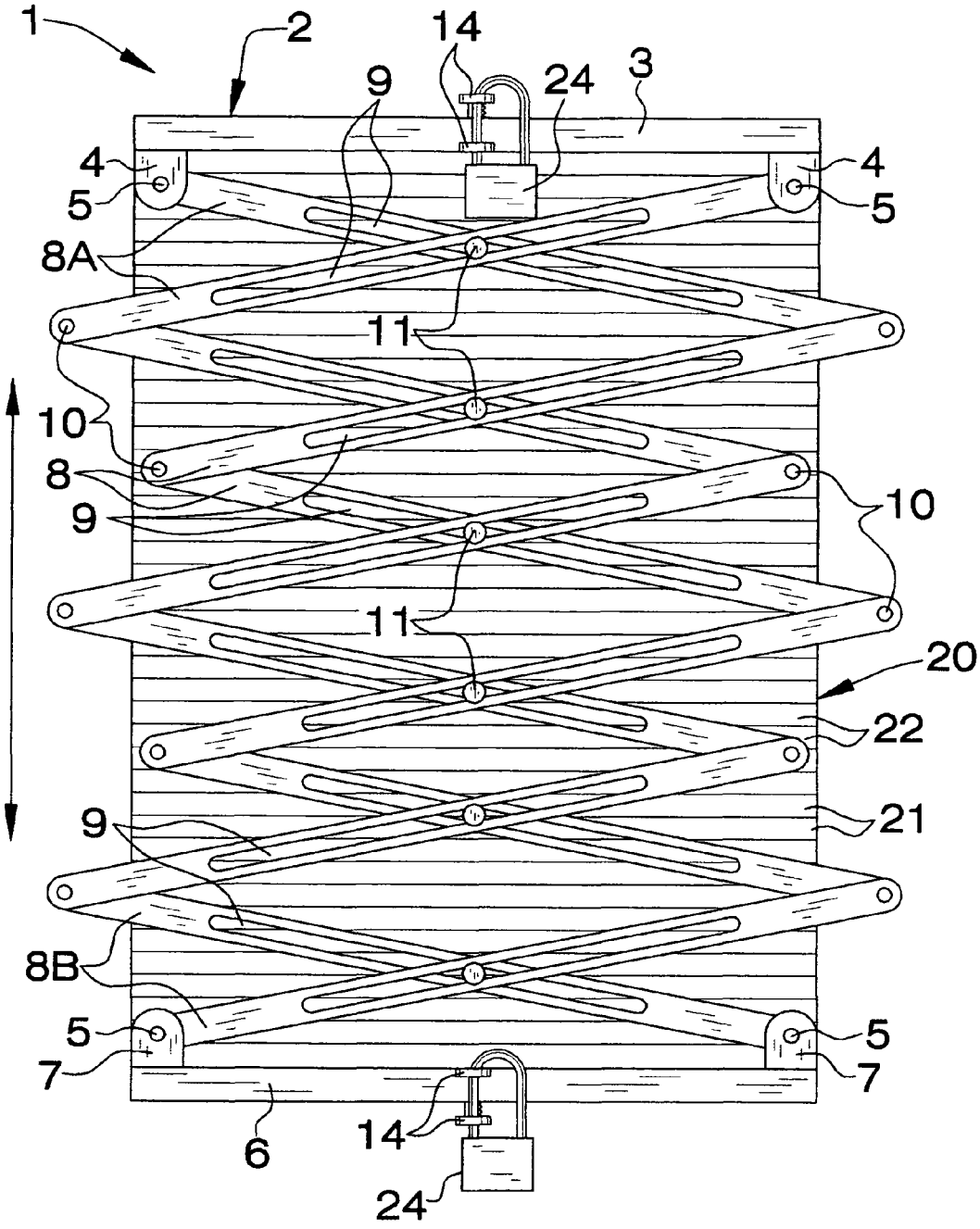
FIG. 4 is a rear view of an illustrative embodiment of the ladder locking device, disposed in a compressed configuration.

Multiple frame segments 8 are pivotally attached to the terminal frame segments 8*a* and the terminal frame segments 8*b* and to each other. Accordingly, a pivot pin 10 extends through registering pin openings (not shown) provided in each end portion of each frame segment 8 and the adjacent frame segment 8, terminal frame segment 8*a* and a terminal frame segment 8*b* to pivotally connect the frame segments 8, frame segments 8*a* and frame segments 8*b* to each other in intersecting relationship to each other. An elongated frame slot 9 extends through each terminal frame segment 8*a*, each terminal frame segment 8*b* and each frame segment 8. A slide pin 11 extends through the frame slots 9 of adjacent frame segments 8 to slidably attach the frame segments 8 to each other. Therefore, the frame segments 8, terminal frame segments 8*a* and terminal frame segments 8*b* are attached to each other in a scissors jack configuration between the terminal frame member 3 and the terminal frame member 6. Therefore, the frame 2 is positional between an extended configuration shown in FIG. 2 and a compressed configuration shown in FIG. 4 to vary the length of the frame 2. As the terminal frame member 3 and the terminal frame member 6 of the frame 2 are moved toward and away from each other, the terminal frame segments 8*a* pivot with respect to the terminal frame member 3 and the terminal frame segments 8*b* pivot with respect to the terminal frame member 6 along the respective pivot pins 5. Simultaneously, the frame segments 8 and terminal frame segments 8*a* and 8*b* pivot with respect to each other along the pivot pins 10 and the slide pins 11 traverse the frame slots 9 of the respective frame segments 8 and terminal frame segments 8*a* and 8*b*.

Figure 3:
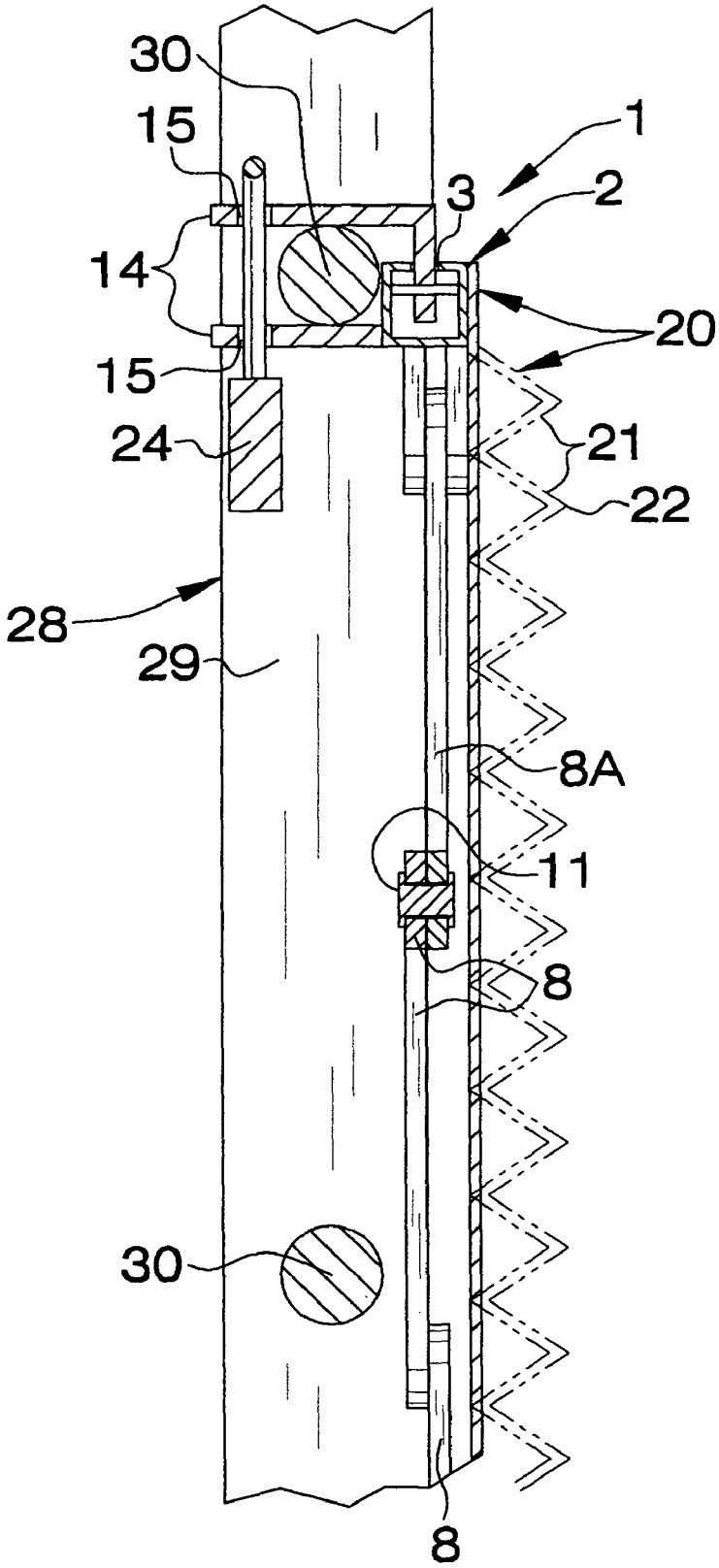
FIG. 3 is a sectional view, taken along section lines 3-3 in FIG. 1, of an illustrative embodiment of the ladder locking device attached to a ladder.

A compressible and extendable foldable blind 20 is provided on the frame 2. The foldable blind 21 includes multiple blind segments 21 which are pivotally connected to each other along fold lines 22. As shown in FIG. 3, the foldable blind 21 is attached to the terminal frame member 3 using adhesives (not shown), fasteners (not shown), welds (not shown) and/or any other suitable technique known to those skilled in the art. The foldable blind 21 is attached to the terminal frame member 6 typically in similar fashion. Therefore, as shown in FIG. 3, as the frame 2 is positioned between the extended configuration shown in FIG. 2 and the compressed configuration shown in FIG. 4, the foldable blind 20 likewise expands and contracts as the blind segments 21 fold or pivot with respect to each other along the fold lines 22, in an accordion-like fashion. In FIG. 3, the solid lines of the foldable blind 20 correspond to the position of the foldable blind 20 when the frame 2 is in the extended configuration, whereas the phantom lines correspond to the position of the foldable blind 20 when the frame 2 is in the compressed configuration.

Figure 1:
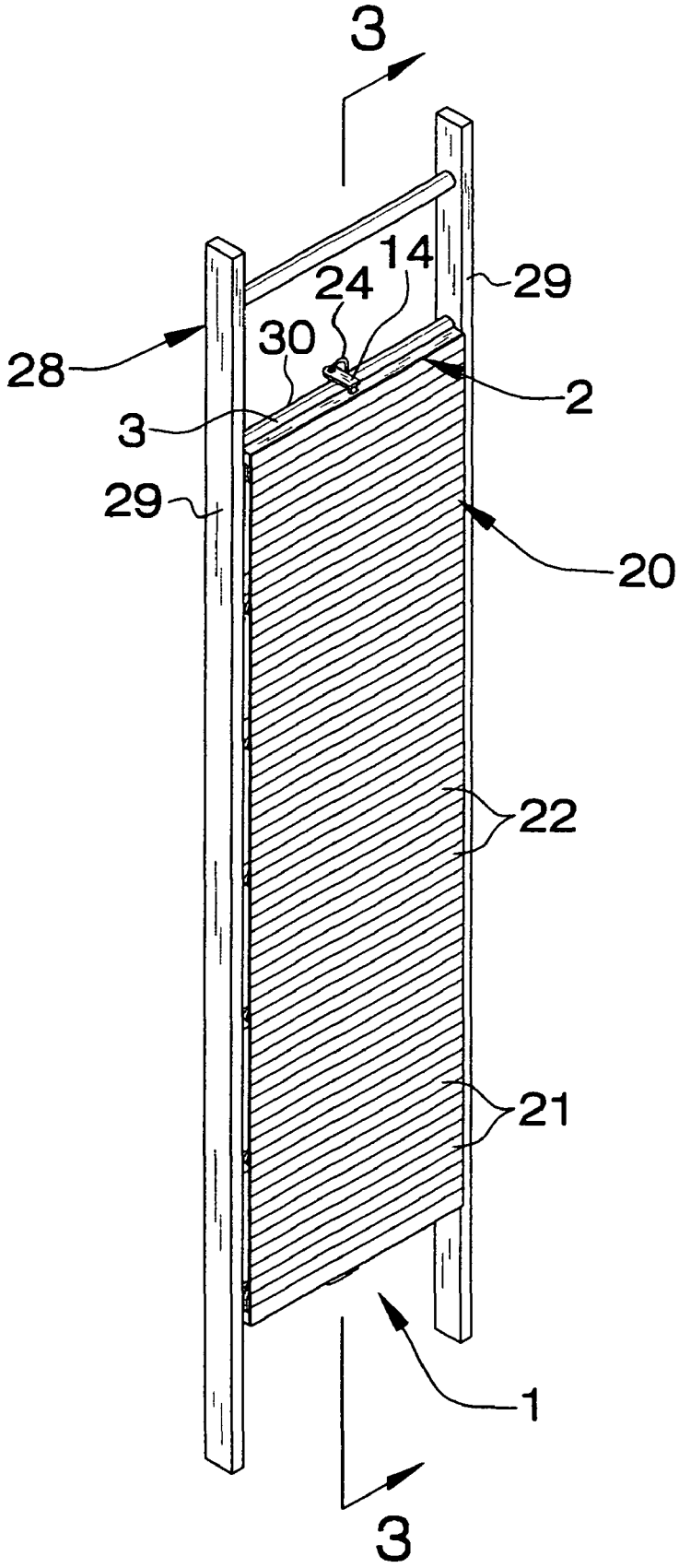
FIG. 1 is a perspective view of an illustrative embodiment of a ladder locking device, attached to a ladder.

Referring next to FIG. 2, in typical application, the ladder locking device 1 is attached to a ladder 28 to prevent unauthorized use of the ladder 28. The ladder 28 may be conventional and includes, for example, a pair of elongated, parallel, spaced-apart rung supports 29. Multiple rungs 30 extend between the rung supports 29 in parallel, spaced-apart relationship to each other. As shown in FIG. 2, the lock flanges 14 which extend from the terminal frame member 3 of the frame 2 are placed on opposite sides of a rung 30 which is located at or adjacent to one end of the ladder 28. A padlock 24 is extended through the aligned lock flange openings 15 of the lock flanges 14 and locked on the side of the rung 30 which is opposite the terminal frame member 3, as shown in FIG. 3. The frame 2 and foldable blind 20 are then extended and the lock flanges 14 which extend from the terminal frame member 6 of the frame 2 are placed on opposite sides of a rung 30 which is located at or adjacent to the opposite end of the ladder 28. A padlock 24 is extended through the aligned lock flange openings 15 of the lock flanges 14 and locked on the side of the rung 30 which is opposite the terminal frame member 6, as was heretofore described with respect to the terminal frame member 3 shown in FIG. 3. Therefore, as shown in FIG. 1, the foldable blind 20 of the ladder locking device 1 blocks unauthorized access to the rungs 30 of the ladder 28, thereby preventing unauthorized access of persons to the ladder 28. The ladder locking device 1 is selectively removed from the ladder 28 by unlocking and removing the padlocks 24 and removing the lock flanges 14 from the respective rungs 30 of the ladder 28.

While the preferred embodiments of the invention have been described above, it will be recognized and understood that various modifications can be made in the invention and the appended claims are intended to cover all such modifications which may fall within the spirit and scope of the invention.

What is claimed is:

1. A ladder locking device, comprising:

a frame having an elongated first terminal frame member, an elongated second terminal frame member spaced-apart from said first terminal frame member and plurality of intersecting frame segments pivotally connected to said first terminal frame member and said second terminal frame member and each other in a scissors jack configuration;

a pair of spaced-apart lock flanges receiving a respective rung of a ladder carried by each of said first terminal frame member and said second terminal frame member; and a pair of lock flange openings extending through said pair of lock flanges, respectively, and a padlock extending through said pair of lock flange openings; and a foldable blind carried by said first terminal frame member and said second terminal frame member of said frame further comprising a plurality of frame flanges carried only at each end of said first terminal frame member and said second terminal frame member, wherein each frame flange comprises a pair of spaced-apart flanges and wherein said plurality of intersecting frame segments is pivotally attached to the first and second terminal frame members only by said plurality of frame flanges, a plurality of frame slots provided in said plurality of intersecting frame segments, respectively, and a slide pin extending through said frame slots of adjacent ones of said plurality of intersecting frame segments.

2. The ladder locking device of claim 1 wherein said foldable blind comprises a plurality of blind segments pivotally connected to each other.

* * * * *